US006135067A

United States Patent [19]

Klamm et al.

[11] Patent Number: 6,135,067

[45] Date of Patent: Oct. 24, 2000

[54] SYSTEM REMOVING ENTRAPPED GAS FROM AN ENGINE COOLING SYSTEM

[75] Inventors: Thomas L. Klamm, Racine; Robert D. Braun, Kenosha, both of Wis.

[73] Assignee: UView Ultraviolet Systems, Inc., Mississauga, Canada

[21] Appl. No.: 09/138,231

[22] Filed: Aug. 21, 1998

[51] Int. Cl.[7] ..... F01P 3/22

[52] U.S. Cl. ..... 123/41.54; 123/41.01; 123/41.08; 165/104.32

[58] Field of Search ..... 123/41.01, 41.54, 123/41.08; 165/104.27, 104.32, 104.34

[56] References Cited

U.S. PATENT DOCUMENTS

| | | | |
|---|---|---|---|
| 3,576,181 | 4/1971 | Neal et al. | 123/41.51 |
| 3,989,102 | 11/1976 | Jaster et al. | 165/104.31 |
| 4,052,965 | 10/1977 | Morris | 123/41.05 |
| 4,185,751 | 1/1980 | Moore et al. | 220/203 |
| 4,271,976 | 6/1981 | Detwiler | 220/206 |
| 4,549,505 | 10/1985 | Hirano | 123/41.08 |
| 4,592,418 | 6/1986 | Cadars | 165/104.32 |
| 4,662,317 | 5/1987 | Ogawa | 123/41.21 |
| 4,722,305 | 2/1988 | Haskell | 123/41.27 |
| 4,782,689 | 11/1988 | DeRome | 73/49.2 |
| 4,888,980 | 12/1989 | DeRome | 73/49.2 |
| 5,186,242 | 2/1993 | Adachi et al. | 165/110 |
| 5,241,926 | 9/1993 | Sato et al. | 123/41.54 |
| 5,248,052 | 9/1993 | Mellinger et al. | 220/202 |
| 5,318,700 | 6/1994 | Dixon et al. | 210/167 |
| 5,353,751 | 10/1994 | Evans | 123/41.01 |
| 5,381,762 | 1/1995 | Evans | 123/41.54 |
| 5,390,636 | 2/1995 | Baylor et al. | 123/198 A |
| 5,535,818 | 7/1996 | Fujisaki et al. | 165/104.33 |

OTHER PUBLICATIONS

D. Cappert, "Let It Bleed", *Super Automotive Service,* pp. 22–25, Oct. 1989.

E. Carpenter, "Vac–U–Fill Coolant Filler", *Circle Track,* pp. 132–133, Feb. 1997.

*Primary Examiner*—Tony M. Argenbright
*Assistant Examiner*—Hai Huynh
*Attorney, Agent, or Firm*—Bell, Boyd & Lloyd LLC

[57] ABSTRACT

An apparatus includes a closed container having an inlet connected to a radiator of an engine cooling system. An outlet of the container is coupled to the suction port of a venturi that has an inlet port connected by a solenoid valve to a source of pressurized air. A controller opens the solenoid valve for a given interval whenever the engine is turned off. That action creates a negative pressure in the container which bleeds gas from the radiator. Any coolant that also is removed from the radiator is collected in the container.

18 Claims, 2 Drawing Sheets

SYSTEM REMOVING ENTRAPPED GAS FROM AN ENGINE COOLING SYSTEM

BACKGROUND OF THE INVENTION

The present invention relates to cooling systems for internal combustion engines, such as those used in motor vehicles; and more particularly to mechanisms for releasing gas contained in such cooling systems.

Internal combustion engines typically are cooled by a sealed system through which liquid coolant flows. A pump forces the coolant from a radiator through passages in the engine block during which the coolant absorbs heat from the engine. The heated coolant returns to the radiator where air passing over cooling fins removes heat from the coolant before the pump forces the coolant back into to the engine block.

Although the cooling system is sealed, it has been discovered that combustion gases in the engine cylinders can leak past gaskets and enter the cooling system passages. This is especially prevalent in high compression engines, such as diesel engines commonly used in trucks. Air may also be drawn into the cooling system from leaks on the suction side of the pump.

Such gases may accumulate in pockets of the coolant passages and adversely affect the removal of heat from the adjacent part of the engine block. A significant problem, that results from gases in the cooling system, is cavitation erosion of metal surfaces inside the engine block. Turbulence of the liquid coolant flowing through the cooling system divides the gas into tiny bubbles which impact the passage walls. Over a relatively short time repeated impacts of the gas bubbles produces pits in the passage walls resulting in engine deterioration.

SUMMARY OF THE INVENTION

The general object of the present invention is to provide a system for occasionally removing accumulated gas from the cooling system of an internal combustion engine.

A further object is to provide such a system that does not require extensive modification of the existing engine cooling system.

Another aspect of the preferred embodiment of the present invention is to provide a mechanism for recovering any coolant that may be removed inadvertently from the cooling system while relieving the gases.

These and other objectives are satisfied by an apparatus which includes a closed collection container having an inlet and an outlet. A drain tube connects the inlet of the closed collection container to the cooling system at a place where gas tends to accumulate. Preferably the drain tube connects to an overflow fitting on the cooling system radiator.

A source of suction is coupled to the outlet of the closed collection container and responds to a control signal by creating pressure in the closed collection container that is less than pressure within the cooling system thereby drawing the coolant into the collection container. In the preferred embodiment of the present invention, the source of suction includes a venturi through which pressurized air flows to create a negative pressure that provides suction to the collection container. A solenoid valve in that embodiment controls the flow of pressurized gas from an air tank of the vehicle to the venturi.

The control signal for operating the source of suction is provided by a controller. Preferably the controller includes a timer that is activated when the engine of the motor vehicle is turned off, so that suction is provided for a given interval. During that interval, accumulated gas is drawn from the cooling system.

The collection container captures any coolant that is drawn from the cooling system by the suction. When the engine cools down, the coolant volume decreases creating a partial vacuum which draws the coolant from the container back into the cooling system.

DETAILED DESCRIPTION OF THE INVENTION

Figure 1:
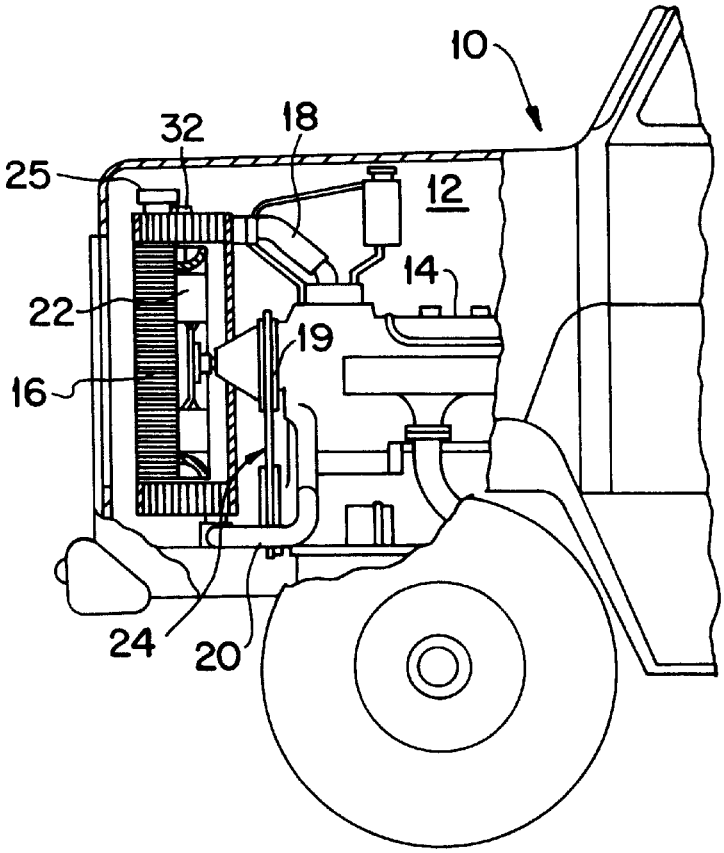
FIG. 1 is a partially cut-away view of a motor vehicle showing the interior of the engine compartment.

With initial reference to FIG. 1, a motor vehicle 10 has a compartment 12 that houses an engine 14. The engine 14 is connected to a conventional cooling system which comprises a radiator 16 in front of the engine and connected thereto by an upper radiator hose 18 and a lower radiator hose 20. A removable cap 25 is attached to a neck 27 at the top of the radiator 16 for adding coolant to the cooling system.

The cooling system contains a conventional liquid coolant made up of a mixture of water and an additive, such as propylene glycol. A pump 19 forces the coolant in a closed circuit from the radiator 16 through the engine 14 and back to the radiator. The pump 19 and a fan 22 are driven by a pulley and belt arrangement 24 on the engine. The fan draws air through the radiator 16 to remove heat from the coolant.

Figure 2:
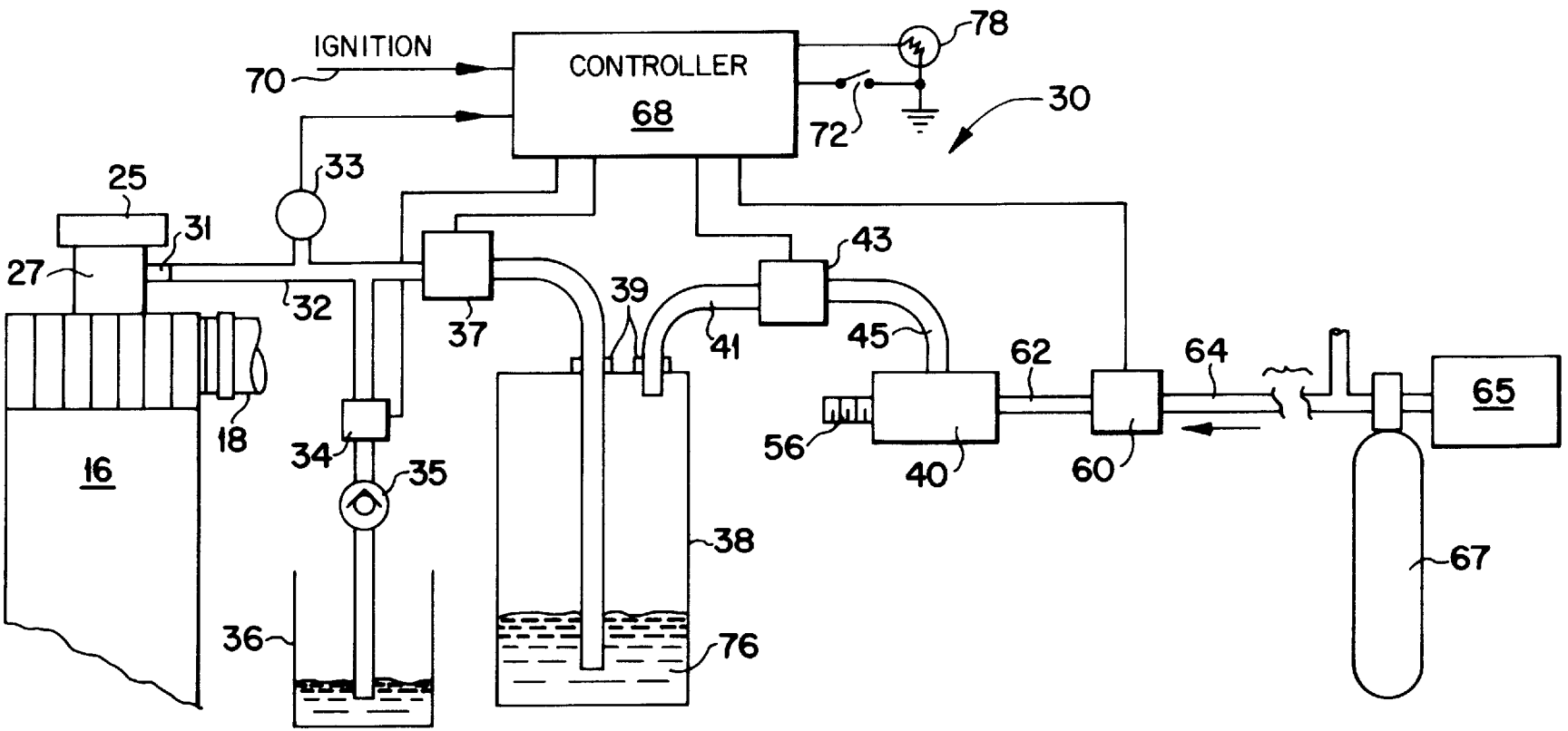
FIG. 2 is a block diagram of a system for removing gases from a motor vehicle cooling system.

FIG. 2 depicts the present system 30 for removing gases that accumulate in the engine cooling system as a result of combustion gases leaking past gasket seals and air being drawn in through leaks on the suction side of the coolant pump. A rubber drain tube 32 is attached to an overflow outlet 31 on a radiator filler neck 27 and leads to a collection container. This type of connection is commonly used to recover the coolant that is expelled from the radiator when the internal pressure rises about a predefined limit opening a pressure relief valve in the radiator cap. However, the present radiator cap 25 does not have a pressure relief valve and merely seals the top opening of the filler neck 27. In other words the overflow outlet 31 always is in fluid communication with the interior of the radiator 16.

A drain tube 32 extends from the radiator overflow outlet 31 to a pressure sensing transducer 33 which produces an electrical signal indicating the radiator pressure. The drain tube 32 also leads to a normally-open, overflow solenoid valve 34 connected in series with a check valve 35 which only allows coolant to flow from the radiator into a overflow reservoir 37. The overflow reservoir 36 is open to the atmosphere.

A normally-closed, inlet solenoid valve 37 also is connected to the drain tube 32 to control the flow of air and coolant from the radiator 16 to an air-tight collection container 38 with seals 39 around inlet and outlet openings. The tube 32 from the radiator 16 terminates inside container 38 near the bottom. A suction tube 41 leads from an upper section of the collection container 38 to a normally-closed, outlet solenoid valve 43, which controls fluid flow to the suction port of a venturi 40.

Figure 3:
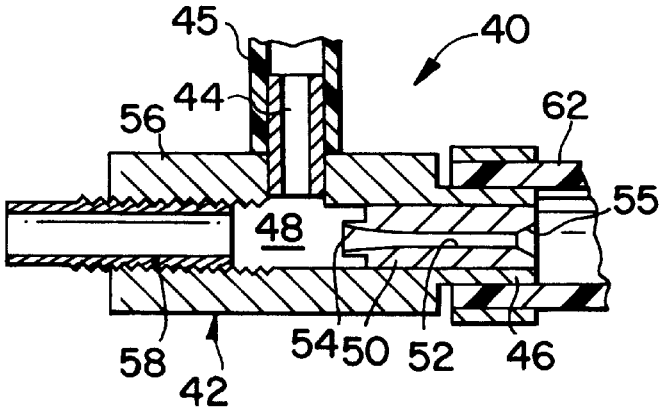
FIG. 3 is a cross sectional view of a venturi for creating a pressure differential the present system.

The structure of the venturi 40 is illustrated in FIG. 3 and comprises a T-shaped body 42 with a center suction port 44 coupled to a tube 45 from the collection container 38. An inlet port 46 of the body 42 has an internal sleeve 50 with a relatively small passage 52 therethrough. The outer end of the passage 52 has a flaired opening 55 and the inner end has a very slightly flaired opening 54. Although the venturi 40 is shown with separate components for the body 42, sleeve 50 and a fitting of the suction port 44, those components could be integrated into a single piece body. An outlet port 56 of the venturi 40 is formed by a tuning tube 58 threaded into an aperture in body 42, thereby enabling the depth to which the tuning tube extends into the body to be adjusted. Such adjustment of the tuning tube 58 depth varies the magnitude of suction developed at the suction port 44, as will be described.

Referring again to FIG. 2, the inlet port 46 of the venturi 40 is connected to an air supply solenoid valve 60 by a hose 62. This solenoid valve 60 controls the flow of compressed air supplied through conduit 64 from a compressor 65 and storage tank 67 on the motor vehicle. For example, the compressed air can be furnished from the tank 67 that supplies the vehicle air brakes.

The electrically operated solenoid valves 34, 37, 43 and 60 are controlled by separate signals from a controller 68. The pressure sensing transducer 33 transmits a pressure indication signal to the controller. The controller 68 also receives an ignition signal that indicates whether or not the engine 14 is operating. A manual switch 72 is provided so that the gas removal system 30 can be disabled by a mechanic while working on the motor vehicle 10.

The gas removal system 30 is operated occasionally to bleed gases from the engine cooling system. A significant portion of those gases accumulate at the top of the radiator 16 as that is the highest part of the cooling system. In the preferred embodiment, the gas removal system 30 is activated whenever the engine 14 is turned off. Specifically, by monitoring the ignition input 70, the controller 68 is able to determine when the engine is turned off. When that event is detected the controller 68 begins monitoring the radiator pressure as indicated by the signal from the transducer 33. When that pressure has decreased to substantially the normal atmospheric pressure (e.g. 1–3 psi), as happens when the temperature of the coolant has cooled to approximately the ambient temperature, the controller 68 responds by first closing overflow solenoid valve 34 and then opening solenoid valves 37, 43 and 60.

Opening the air supply solenoid valve 60 allows compressed air from supply conduit 64 to flow through the venturi 40, entering inlet port 46 and exiting the outlet port 56, as seen in FIG. 3. Because internal sleeve 50 provides a restricted passage 52, the speed of the air flow increases going through the body 42 of the venturi 40. That air flow creates a pressure in the internal venturi chamber 48 that is below atmospheric pressure, thereby creating a negative pressure at the suction port 44. The magnitude of the negative pressure can be tuned to an optimum level by varying the depth to which the tuning tube 58 extends into the body 42, for example the tuning tube 58 is adjusted to provide a negative pressure of approximately seven psi. The pressure differential draws air from the collection container 38, thereby creating a partial vacuum in that container. Alternatively, other types of vacuum sources can be employed with the present gas removal system.

That partial vacuum is transferred through the radiator drain tube 32 to inside the radiator filler neck 27 which draws gas, that has accumulated at the top of the radiator 16, through drain tube 32 and into the collection container 38. That gas bubbles through any coolant 76 in the bottom of the collection container 38 to suction tube 41 and through oulet soleniod valve 43 to the venturi 40 from which the gas is expelled via outlet port 56. Any coolant that is drawn from the radiator remains in the bottom of the collection container 38.

While the gas is being removed from the radiator 16, the controller 68 monitors the radiator pressure, as indicated by the signal from transducer 33. When radiator reaches a predefined negative pressure, for example 24–26 inches of vacuum, the controller 68 closes the outlet solenoid valve 43 and the air supply solenoid valve 60. This valve closure removes further suction from being applied to the collection container 38, but maintains that container at a significant negative pressure. The inlet solenoid valve 37 remains open so that any additional air that migrates through the cooling system to the top of the radiator 16 still will be drawn into the collection container 38. The overflow solenoid valve 34 is de-energized at this time to return to its normally-open state. However, the check valve 36 prevents air and coolant from being drawn through the overflow solenoid valve 34 into the cooling system by the negative pressure As the negative pressure decays due to minute leaks in the cooling system, coolant 76 that entered the collection container 38 during the gas removal process will be returned to the radiator 16.

Controller 68 monitors the rate at which the negative pressure decays. Too rapid a decay is an indication that the cooling system has deteriorated to a point where repair is necessary. Thus, if the radiator pressure rises by more than a given amount within a defined period of time, the controller 68 illuminates a lamp 78 on the dashboard of the motor vehicle to alert the operator that cooling system service is required.

When the engine 14 starts again, the controller 68 opens both the inlet and outlet solenoid valves 37 and 43 to draw coolant from the collection container 38 into the radiator 16 thereby releasing any residual negative pressure. The coolant removed from the collection container 38 is replaced by air entering through the venturi 40 and the outlet valve 43. These valves 37 and 43 are closed by the controller 68 after a brief pressure recovery period.

What is claimed is:

1. An apparatus for removing gas from a cooling system of an engine, said apparatus comprising:

a closed collection container having an inlet and an outlet;

drain conduit connecting the cooling system to the inlet of the closed collection container;

a source of suction coupled to the outlet of the closed collection container and responding to a control signal by creating a given pressure in the closed collection container that is less than pressure within the cooling system, thereby drawing the gas into the closed collection container from the cooling system;

a controller which produces the control signal; and a transducer that senses pressure in the cooling system and produces a pressure signal, wherein the controller produces the control signal in response to the pressure signal.

2. The apparatus as recited in claim 1 wherein the source of suction comprises a venturi having an inlet port which is coupled to a source of a pressurized fluid, an outlet port and a suction port to which the outlet of the closed collection container is connected, wherein a flow of fluid from the inlet port to the outlet port creates suction at the suction port which draws gas from the cooling system into the closed collection container.

3. The apparatus as recited in claim 2 wherein the inlet port of the venturi is coupled to an air compressor.

4. The apparatus as recited in claim 2 wherein the inlet port of the venturi has a first passage with a cross-sectional area that is smaller than a cross-sectional area of a second passage through the outlet port.

5. The apparatus as recited in claim 2 wherein the venturi comprises a body which defines the inlet port and the suction port and which has an aperture in communication with the inlet port and the suction port; and a tuning tube inserted into the aperture to form the outlet port, a depth to which the tuning tube is inserted into the aperture being variable to vary suction created at the suction port.

6. The apparatus as recited in claim 2 wherein the inlet port is coupled to the source of a pressurized fluid by a valve which is operated in response to the control signal.

7. The apparatus as recited in claim 6 wherein the controller produces the control signal for a defined interval.

8. The apparatus as recited in claim 1 wherein the controller produces the control signal in response to the engine being turned off.

9. An apparatus for removing gas from a cooling system of an engine wherein the cooling system has a radiator with an outlet, said apparatus comprising:

a closed collection container having an inlet and an outlet;

an inlet valve coupling the inlet of the closed collection container to the cooling system;

a controller connected to the inlet valve and the outlet valve, and controlling opening and closing of the valves in response to an operating parameter of the engine; and a transducer that senses pressure in the cooling system and produces a pressure signal, wherein the controller opens the inlet and outlet valves in response to the pressure signal.

10. The apparatus as recited in claim 9 wherein the controller is operatively connected to detect whether the engine is operating, and the controller opens the inlet and outlet valves in response to the engine making a transition from operating to not operating.

11. The apparatus as recited in claim 9 further comprising a venturi with an inlet port, an outlet port and a suction port wherein the suction port is coupled by the outlet valve to the outlet of the closed collection container; and a supply valve coupling the inlet port of the venturi to a source of pressurized fluid.

12. The apparatus as recited in claim 11 wherein the controller is connected to the engine to detect whether the engine is operating.

13. The apparatus as recited in claim 12 wherein the controller opens the inlet, outlet and supply valves in response to the engine being turned off and the pressure in the cooling system reaching a predefined level.

14. The apparatus as recited in claim 12 wherein the controller closes the outlet and supply valves in response to a predetermined level of vacuum being created in the cooling system.

15. The apparatus as recited in claim 12 further comprising an overflow valve connected to the cooling system and to the controller, wherein the overflow valve is open while the engine is operating.

16. The apparatus as recited in claim 15 further comprising a recovery container connected to receive coolant which flows through the overflow valve; and a check valve connected in series with the overflow valve between the cooling system and the recovery container to prevent coolant from flowing from the recovery container to the cooling system.

17. The apparatus as recited in claim 9 wherein the controller opens the inlet and outlet valves in response to the engine starting operation.

18. The apparatus as recited in claim 9 further comprising a venturi with an inlet port, an outlet port and a suction port wherein the suction port is coupled by the outlet valve to the outlet of the closed collection container; and a supply valve coupling the inlet port of the venturi to a source of pressurized fluid.

* * * * *